US011641905B1

(12) United States Patent
Phukan

(10) Patent No.: US 11,641,905 B1
(45) Date of Patent: May 9, 2023

(54) METHOD OF REINFORCING A FENCING SHOE

(71) Applicant: Rohin Phukan, La Crescenta, CA (US)

(72) Inventor: Rohin Phukan, La Crescenta, CA (US)

( * ) Notice: Subject to any disclaimer, the term of this patent is extended or adjusted under 35 U.S.C. 154(b) by 0 days.

(21) Appl. No.: 17/984,179

(22) Filed: Nov. 9, 2022

Related U.S. Application Data

(62) Division of application No. 17/696,503, filed on Mar. 16, 2022.

(51) Int. Cl.
*A43B 5/00* (2022.01)

(52) U.S. Cl.
CPC ..... *A43B 5/00* (2013.01)

(58) Field of Classification Search
CPC ..... A43B 5/0404; A43B 5/18; A43B 23/0045; A43B 23/0047; A43B 23/26; A43B 23/08; A43B 23/24
See application file for complete search history.

(56) References Cited

U.S. PATENT DOCUMENTS 681,898 A * 9/1901 Webber ..... A43B 23/26 24/715.6
1,472,415 A * 10/1923 Haggerty ..... A43B 5/00 36/89
3,427,020 A * 2/1969 Frederick ..... A63B 21/065 482/79
3,601,909 A * 8/1971 Amendola ..... A43B 3/0078 D2/975
3,994,080 A * 11/1976 Flanagan, Jr. ..... A43B 1/0027 36/100
4,254,566 A * 3/1981 Haskell ..... G09F 3/04 40/636
4,296,559 A * 10/1981 Gamm ..... A43C 11/1493 36/136
5,027,482 A * 7/1991 Torppey ..... A43C 11/1493 24/712.1
5,094,016 A * 3/1992 DiVito ..... A43B 3/0031 36/1
D335,949 S * 6/1993 Rogers ..... D2/972
5,311,679 A * 5/1994 Birch, Sr. ..... A43C 1/00 2/919
5,459,947 A * 10/1995 Lasher ..... A43C 1/00 24/306
5,566,477 A * 10/1996 Mathis ..... A43B 23/24 36/132
5,671,517 A * 9/1997 Gourley ..... A43B 3/0078 24/712.1
5,894,640 A * 4/1999 Dewey ..... A43C 11/00 24/575.1
6,000,111 A * 12/1999 Deskins ..... A43C 7/02 24/712.1

(Continued)

*Primary Examiner* — Bao-Thieu L Nguyen
(74) *Attorney, Agent, or Firm* — Umberg Zipser LLP

(57) ABSTRACT

Provided herein are shoe protectors, comprising: a first portion that is coupled to a second portion along a line that conforms to a topline of a medial collar of a shoe; wherein the first portion is configured to extend from the topline into an inside of the shoe; wherein the second portion is configured to extend from the topline to cover at least part of an outside of the shoe extending horizontally from a proximal phalanx region to a heel region; wherein the second portion comprises a plurality of eyelets in an eyestay region and an adhesive at a lower region of the second portion.

9 Claims, 6 Drawing Sheets

(56) References Cited

U.S. PATENT DOCUMENTS 6,128,801 A * 10/2000 Adzick ..... A43B 23/26 15/210.1
6,212,797 B1 * 4/2001 Merry ..... A43D 999/00 36/127
6,449,881 B1 * 9/2002 Assaf ..... A43B 23/26 150/144
7,428,787 B2 9/2008 Crowley et al.
7,444,724 B1 * 11/2008 Perler ..... A43B 23/24 24/712.3
7,543,397 B2 * 6/2009 Kilgore ..... A43B 23/07 36/50.1
7,685,739 B2 * 3/2010 Aveni ..... A43B 3/24 36/8.3
D639,031 S * 6/2011 Smith ..... D2/976
8,677,578 B2 * 3/2014 Singh ..... A43C 7/005 24/712.2
9,770,062 B1 9/2017 Armetta
10,772,753 B2 * 9/2020 Gaylord ..... A61F 5/0118
10,897,954 B2 * 1/2021 Knutson ..... A43B 7/34
D968,767 S * 11/2022 Phukan ..... D2/901
2001/0042323 A1 11/2001 Fusco et al.
2002/0066208 A1 6/2002 Hall
2007/0074425 A1 * 4/2007 Leong ..... A43B 3/12 36/68
2007/0101617 A1 5/2007 Brewer et al.
2008/0078102 A1 4/2008 Kilgore et al.
2008/0141562 A1 6/2008 Peveto
2008/0189985 A1 * 8/2008 Cox ..... A43B 1/0027 36/50.1
2011/0209361 A1 * 9/2011 Cox ..... A43B 3/0031 36/54
2016/0037863 A1 * 2/2016 Harley ..... A43C 7/005 36/72 R
2017/0224047 A1 * 8/2017 Walker ..... A43B 7/1495
2017/0238647 A1 * 8/2017 Sharifi ..... A43B 23/0245
2018/0199670 A1 * 7/2018 Craven ..... A43C 11/24
2018/0263330 A1 * 9/2018 Rhoads ..... A43C 7/02
2020/0229677 A1 * 7/2020 Gonzales ..... A43C 11/004
2020/0297077 A1 * 9/2020 Craven ..... A43C 11/20
2020/0316451 A1 * 10/2020 Van Horne ..... A63C 1/26
2021/0219662 A1 * 7/2021 Walker ..... A43B 23/24

* cited by examiner

METHOD OF REINFORCING A FENCING SHOE

This application is a divisional of U.S. patent application Ser. No. 17/696,503 filed Mar. 16, 2022, which is incorporated by reference in its entirety.

FIELD OF THE INVENTION

The field of the invention is a reinforcement patch or shoe protector to be used by a fencer.

BACKGROUND

The following description includes information that may be useful in understanding the present invention. It is not an admission that any of the information provided herein is prior art or relevant to the presently claimed invention, or that any publication specifically or implicitly referenced is prior art.

All publications and patent applications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The sport of fencing requires intentional asymmetric motions of the feet. One such asymmetric motion is a lunge, which is a fundamental footwork technique used in all three fencing weapons: foil, epee, and sabre, and is common to all contemporary fencing styles. The lunge is executed by kicking forward with the front leg (leading foot) and pushing the body forward with the back leg (trailing foot).

The direction of the forward motion is selected by the leading foot, which is lifted during the lunge and then impacts on the fencing surface. The trailing foot anchors and stabilizes the fencer, and typically slides on the fencing surface for much of the lunge. In that regard, the fencing surface (known as piste) is often metallic such as aluminum, although rubber conductive piste may also be used occasionally.

The lunge is most commonly used to deliver an attack. The foot movements during a lunge results in shoe wear patterns that vary between the leading foot and the trailing foot. The Proximal Phalanx region on the medial side of the trailing foot is dragged during a lunge and suffers significant wear and tear after a few fencing bouts. As a result of this, fencers must change, and ultimately buy new shoes, often on a monthly basis.

Fencing shoes are known in the art and account for asymmetrical motions between the feet. For example, U.S. Pat. No. 7,543,397B2 discloses a fencing shoe that has an asymmetric opening around the foot of the wearer, having a lacing system that is not in the middle but on the lateral (outer) side of the shoe. Even so, for comfort and foot support reasons, most fencers including Olympic level fencers, choose to wear volleyball and/or tennis shoes rather than fencing shoes, and replace their shoes every month due to wear and tear in the medial side of the trailing foot.

Thus, there remains a need in the art for a removable shoe cover or shoe patch that a fencer can use in the medial side of the trailing foot to reduce or eliminate wear and tear caused by a lunge motion.

SUMMARY OF THE INVENTION

In one aspect, disclosed herein is a shoe protector, comprising: a first portion that is coupled to a second portion along a line that conforms to a topline of a medial collar of a shoe; wherein the first portion is configured to extend from the topline into an inside of the shoe; wherein the second portion is configured to extend from the topline to cover at least part of the outside of the shoe extending horizontally from a proximal phalanx region to a heel region; wherein the second portion comprises a plurality of eyelets in an eyestay region and an adhesive at a lower region of the second portion.

Preferably, the plurality of eyelets in the shoe protector snugly and conformally fit over the eyelets of the shoe for threading a cord or lace through and thereby releasably connects to the shoe. The shoe protector is contemplated to be releasably connected to the trailing shoe of a fencer, but not the leading shoe.

An elastic material is used to make the first portion and second portion of the shoe protector. The elastic material may be selected from the group consisting of leather, suede, fabric, rubber and combinations thereof. It is further preferred that the second portion of the shoe protector is formed of an abrasion resistant material.

In some embodiments, the shoe protector further comprises a pocket on the first portion suitable for holding a credit card.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

Exemplary embodiments are illustrated in referenced figures. It is intended that the embodiments and figures disclosed herein are to be considered illustrative rather than restrictive.

DETAILED DESCRIPTION

The described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components and so forth. In other instances, well-known structures, materials, or operations are not shown or described in detail to avoid obscuring aspects of the invention.

Figure 1:
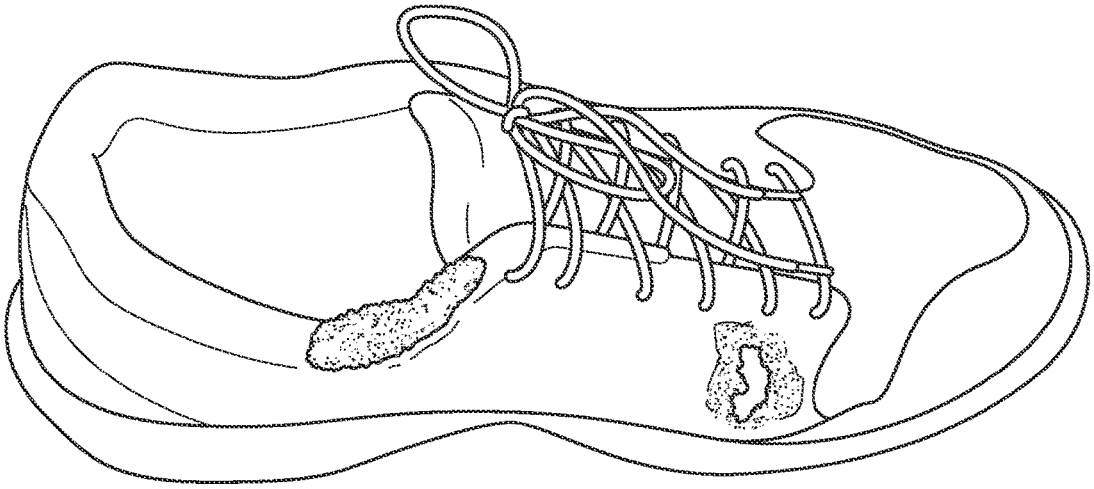
FIG. 1 is a photograph of used fencing shoe worn on the trailing foot and showing wear and tear on the medial side.
Figure 2:
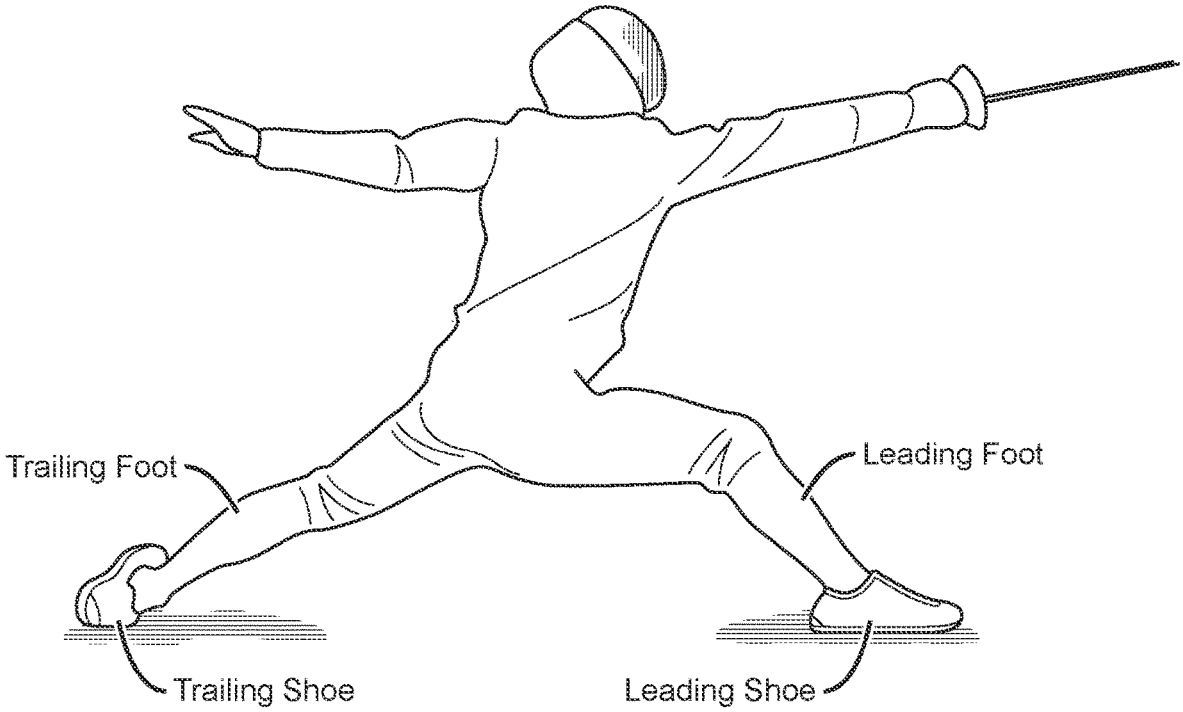
FIG. 2 is a picture of a fencer during the lunge movement.

The inventor, an avid fencer, has found that shoes used for fencing last about 100-150 hours of fencing before a hole appears in the medial side of the trailing foot, and damage is seen along the topline of the medial collar of the shoe. This problem is common to all fencers. FIG. 1 illustrates the problem and shows a shoe that has been used in fencing for about 100 hours, which is usually about 4-6 weeks of training for a competitive fencer. FIG. 2 shows a fencer doing a lunge attack, and it can be seen that the trailing foot/shoe slides on the fencing surface and suffers damage. Such damage requires changing to a new pair of shoes and adds to the cost of an already expensive sport. In an effort to save costs and make fencing more accessible to everyone, the inventor has now invented a shoe protector to be used during fencing. The inventive subject matter disclosed herein overcomes the disadvantages of the prior art and enables the shoes to last longer.

FIGS. 3-11 shows various illustrations of the shoe protector disclosed herein. The shoe protector (100) disclosed herein comprises a first portion (102) that is coupled to a second portion (104) along a line that conforms to a topline (106) of a medial collar (116) of a shoe. The first portion (102) is configured to extend from the topline (106) into an inside of the shoe. The second portion (104) is configured to extend from the topline (106) to cover at least part of an outside of the shoe extending horizontally from a proximal phalanx (108) region to a heel region (110). The second portion also comprises a plurality of eyelets (112) in an eyestay region and an adhesive at a lower region of the second portion (114).

It should be recognized that a proximal phalanx of the foot is the bone in each toe closest to the metatarsal bone that connects to the intermediate phalanx bone. It is intended that the second portion (104) of the shoe protector disclosed herein extends up to and covers the proximal phalanx region of the foot.

The inventor envisions that the number of eyelets (112) in the shoe protector (100) would vary depending on the type of shoe and size of shoe on which the shoe protector is used. Thus, in various embodiments, the plurality of eyelets may be 2 eyelets, or 3 eyelets, or 4 eyelets, or 5 eyelets, or 6 eyelets, or 7 eyelets, or 8 eyelets, or 9 eyelets, or 10 eyelets. Similarly, the spacing between the eyelets varies depending on the type of shoe and the size of shoe. Preferably, the number of eyelets (112) in the shoe protector (100) are the same as the number of eyelets in the shoe and spaced such that the plurality of eyelets of the shoe protector fits over the plurality of eyelets (112) of the shoe.

Figure 9:
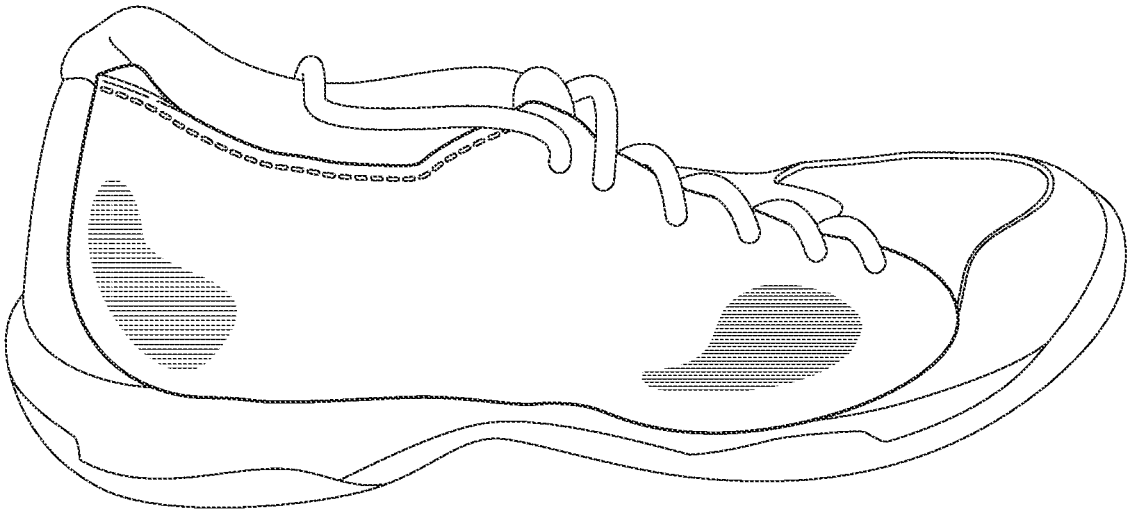
FIG. 9 is a photograph of the shoe protector disclosed herein with the shoe shown as environmental matter.
Figure 10:
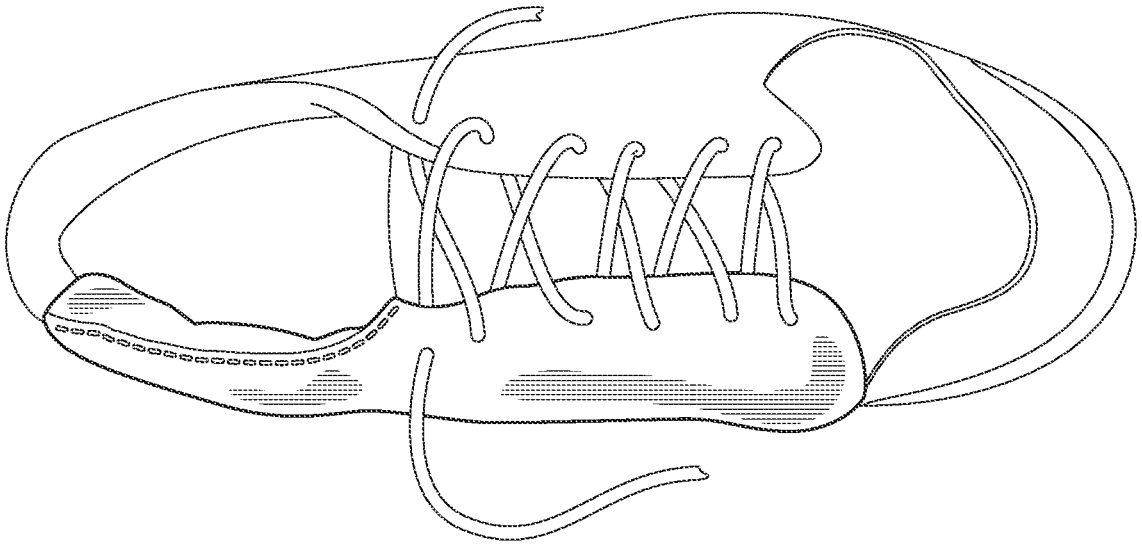
FIG. 10 is a photograph of the shoe protector disclosed herein with the shoe shown as environmental matter.
Figure 11:
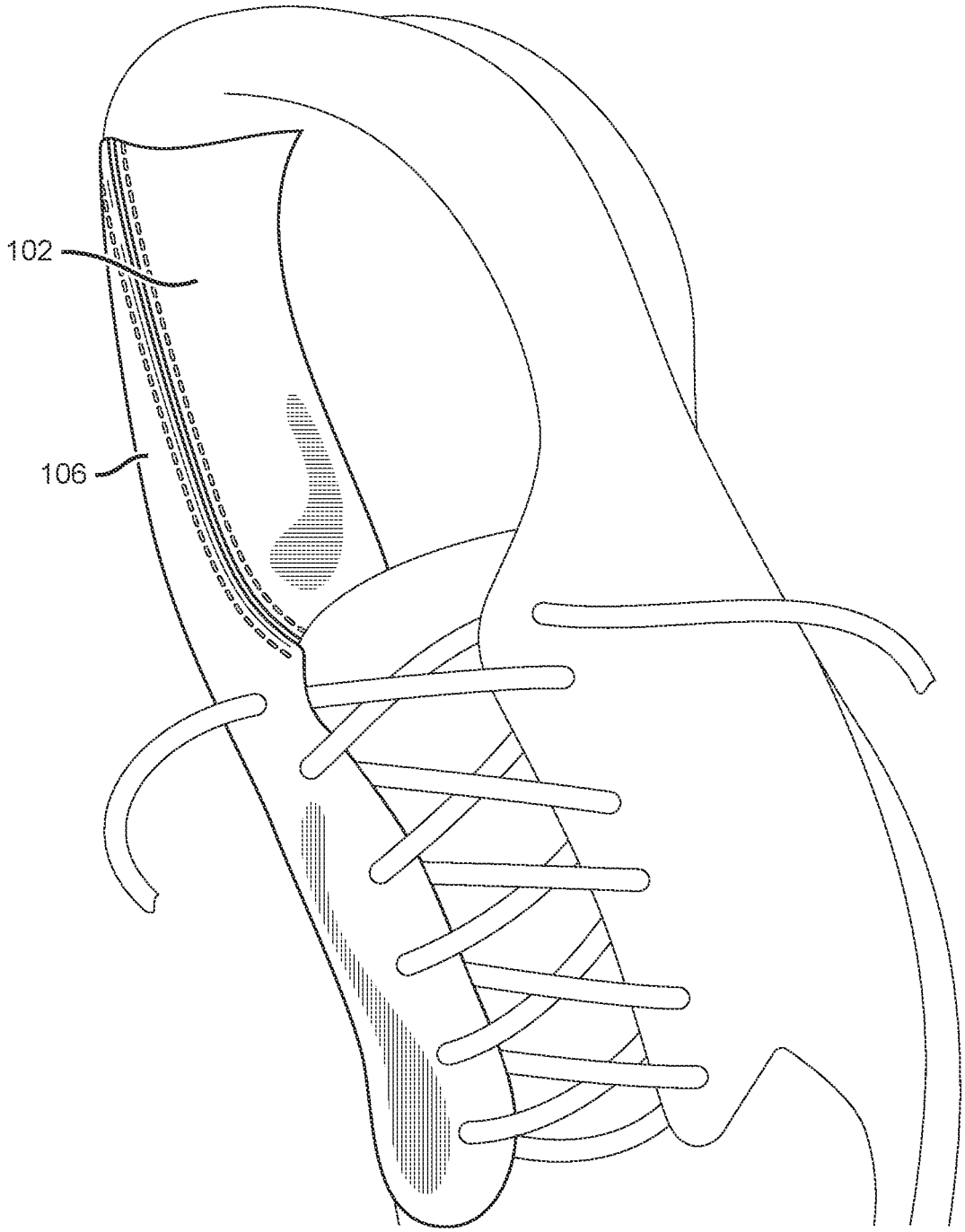
FIG. 11 is a photograph of the shoe protector disclosed herein with the shoe shown as environmental matter.

The plurality of eyelets (112) in the shoe protector (100) snugly and conformally fit over the eyelets of the shoe for threading a cord or lace through and thereby releasably connects to the shoe, as illustrated in FIGS. 9-11. In this regard, the eyestay region (also known as the lace stay) is the section of a shoe where the eyelets are placed, and the laces threaded through. The inventor has unexpectedly and surprisingly found that the shoe protector (100) disclosed herein does not slide around or come loose while fencing on a metallic or rubber piste (fencing strip) with all the forces in play. The use of the shoe protector in only one foot and covering only the problem areas of the shoe adds little weight, does not inhibit or distract in fencing, and elongates the lifespan of the shoe to at least twice, and in some cases up to three times, or up to four times.

Figure 3:
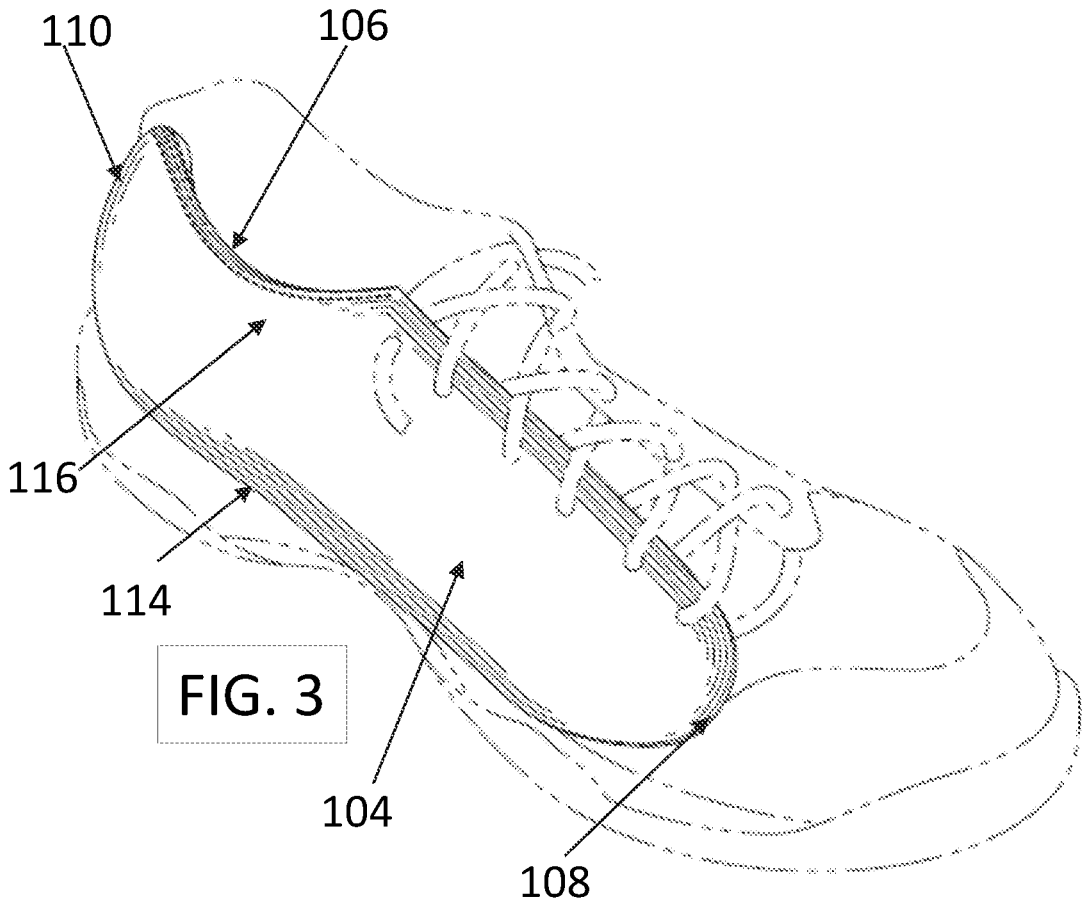
FIG. 3 illustrates one embodiment of the shoe protector disclosed herein with the shoe shown as environmental matter.
Figure 4:
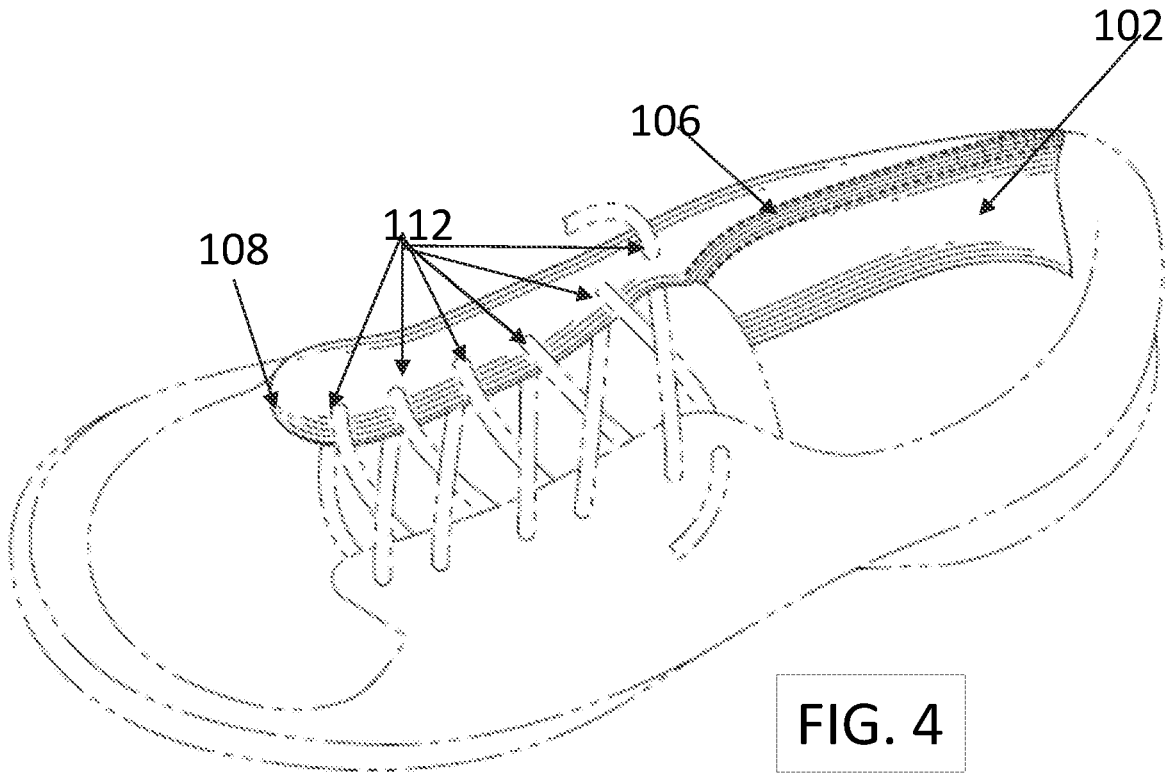
FIG. 4 illustrates one embodiment of the shoe protector disclosed herein with the shoe shown as environmental matter.
Figure 5:
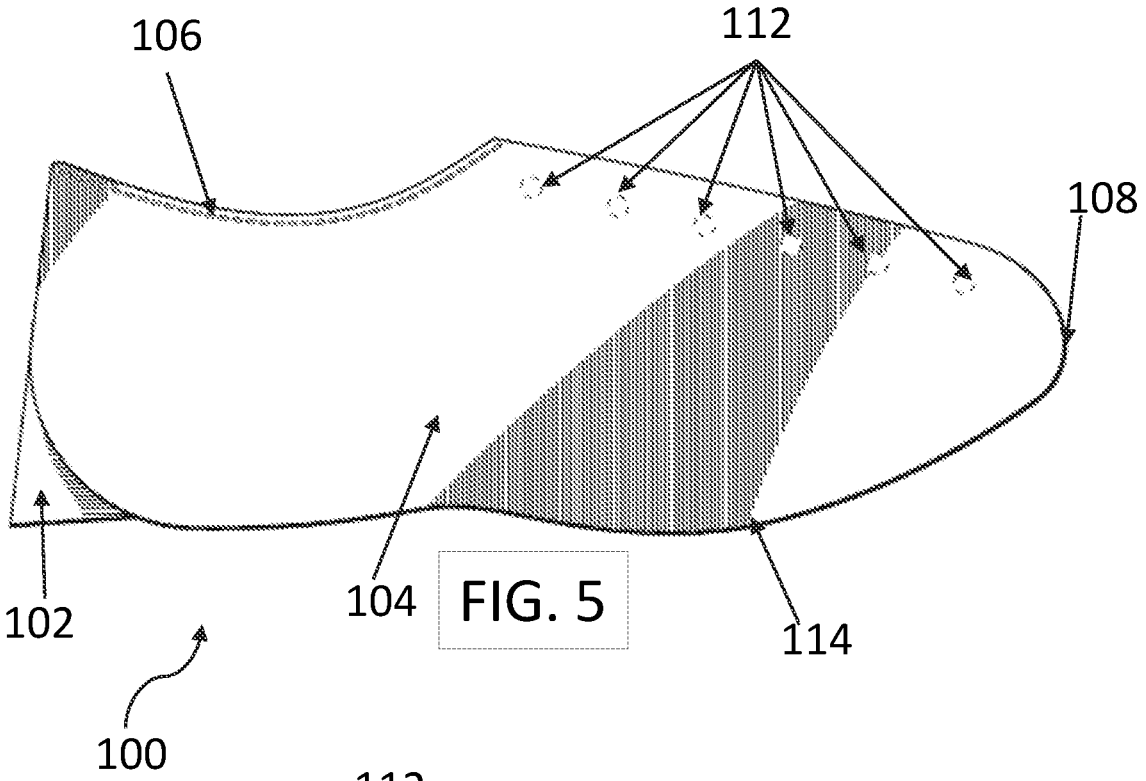
FIG. 5 illustrates an embodiment of the shoe protector disclosed herein.
Figure 6:
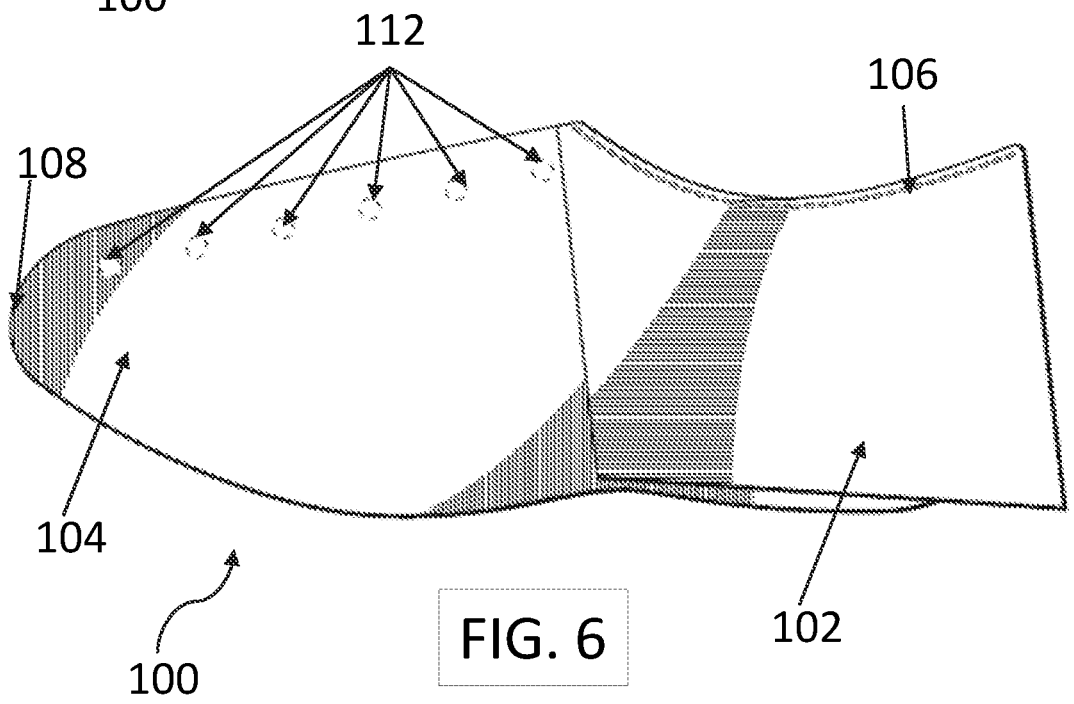
FIG. 6 illustrates an embodiment of the shoe protector disclosed herein.
Figure 7:
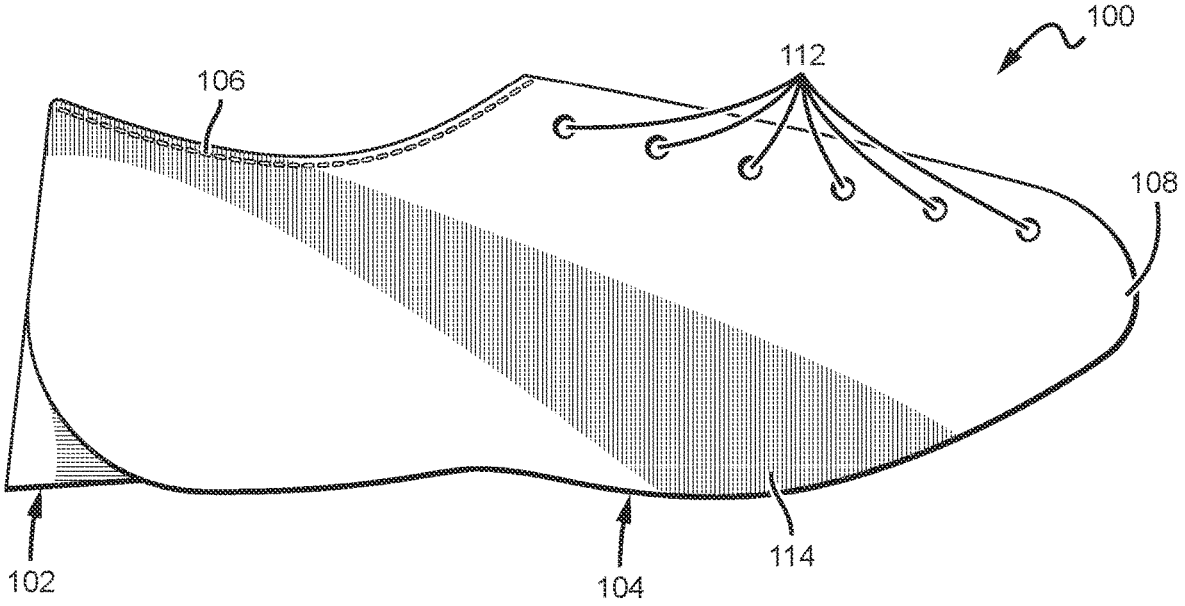
FIG. 7 illustrates an embodiment of the shoe protector disclosed herein.
Figure 8:
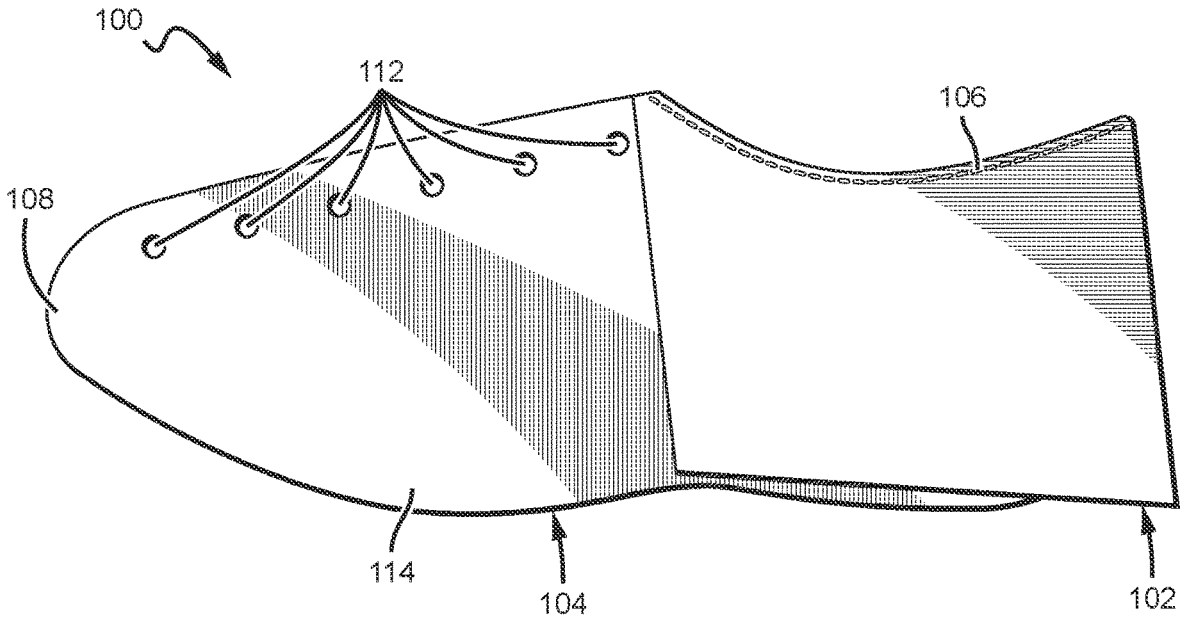
FIG. 8 illustrates an embodiment of the shoe protector disclosed herein.

The shoe protector is designed to include adhesive in the lower region of the second portion (114). The lower region of the second portion (114) of the shoe protector meets the shoe just above the sole of the shoe (as illustrated in FIG. 3, 9) and is secured to the shoe by an adhesive. With the plurality of eyelets (112) in the shoe protector (100) threaded with the eyelets of the shoe on the top part of the shoe protector (100), and with the bottom part of the shoe protector (100) secured to the shoe with an adhesive, it causes the shoe protector (100) to be held tightly against the shoe to avoid having other outside materials or even the other foot from getting caught on the shoe protector. As would be appreciated by those of ordinary skill in the footwear accessary arts, the use of adhesive to secure the shoe protector to the shoe may be substituted with the use of any other suitable fastener, including but not limited to Velcro material, buttons, snaps, hooks and eyes, stitching, and the like.

In some embodiments, optionally, the first portion (102) is secured to the shoe by an adhesive, Velcro, buttons, snaps, or any other suitable fastener. Furthermore, the first portion may also be extended for placement underneath the insole of the shoe. In any case, the first portion is secured inside the shoe in a way so that there is no sliding or any other movement during use of the shoe protector (100). Alternatively, or additionally, the shoe protector (100) may further comprise a removable rivet that pierces from the inside of the shoe through the first portion (102), the side wall of the shoe, and the second portion (104). It is envisioned that the foot-facing side of the rivet would be flat for comfort during wearing. The rivet is preferably made of a flexible, soft, comfortable material, such as rubber, plastic, or leather.

The inventor contemplates that the shoe protector (100) is releasably connected (by threading the cord or lace of the shoe as described above) to the trailing shoe of a fencer, but not the leading shoe. This is because the leading shoe does not get damaged during lunge, only the trailing shoe does (as illustrated in FIG. 1-2). In that regard, it should be noted that trailing foot/shoe of a right-handed fencer is the left foot/shoe, with the right foot/shoe acting as the leading foot/shoe. On the other hand, in case of a left-handed fencer, the trailing foot/shoe is the right foot/shoe, while the left foot/shoe is the leading foot/shoe.

A variety of materials may be used to make the shoe protector (100) disclosed herein. It is generally preferred that the first and second portion (102, 104) of the shoe protector is formed of an abrasion resistant material. An elastic material, such as leather, suede, fabric, rubber, molded plastic, heavy canvas, and combinations thereof, is preferred. Other suitable preferred materials include nitrile, polyurethane, styrene-butadiene rubber, thermoplastic, natural rubber, natural leather, etc. Notably, the first portion (102) and the second portion (104) need not be of the same material. For example, in one exemplary embodiment, the first portion (102) of the shoe protector (100) is made of fabric, while the second portion (104) is made of leather. All other combinations of the various materials disclosed here are contemplated.

It is further contemplated that the shoe protector (100) is both functional and aesthetically pleasing. An optional decorative element may be included on the first portion or the second portion. The decorative element may be embroidery stitched on the second portion, a decal affixed via stitching or an adhesive, a stamp or similar dye-based design imprinted on the shoe protector.

In some embodiments, the first portion (102) of the shoe protector (100) has a pocket suitable for holding a card (such as a credit card) or cash.

The present discussion provides many example embodiments of the inventive subject matter. Although each embodiment represents a single combination of inventive elements, the inventive subject matter is considered to include all possible combinations of the disclosed elements. Thus, if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of items used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification or claims refer to at least one of something selected from the group consisting of A, B, C . . . and N, the text should be interpreted as requiring only one element from the group, not A plus N, or B plus N, etc.

What is claimed is:

1. A method of protecting a trailing shoe of a fencer, the method comprising:

releasably connecting a shoe protector to the trailing shoe, but not a leading shoe of the fencer, wherein the trailing shoe and the leading shoe each have an inside, an outside, a proximal phalanx region, a heel region, an eyestay region, and a medial collar having a topline;

wherein the trailing shoe of a right-handed fencer is the shoe worn on the left foot, and the leading shoe of the right-handed fencer is the shoe worn on the right foot;

wherein the trailing shoe of a left-handed fencer is the shoe worn on the right foot, and the leading shoe of the left-handed fencer is the shoe worn on the left foot; and wherein the shoe protector comprises:

a first portion that is coupled to a second portion along a line that conforms to the topline of the medial collar of the trailing shoe;

wherein the first portion is configured to extend from the topline into the inside of the trailing shoe, and wherein the first portion has a length sufficient to contact on the inside of the trailing shoe a person's foot wearing the trailing shoe;

wherein the second portion is configured to extend from the topline to cover at least part of the outside of the trailing shoe extending horizontally from the proximal phalanx region to the heel region;

wherein the second portion comprises a plurality of eyelets that are positioned to fit over eyelets in the eyestay region of the trailing shoe and an adhesive at a lower region of the second portion.

2. The method of claim 1, wherein the shoe protector is fastened to the trailing shoe via lacing passing through the eyelets of the eyestay and the second portion, and via the adhesive.

3. The method of claim 1, wherein the first portion is formed of an elastic material.

4. The method of claim 1, wherein the second portion is formed of an elastic material.

5. The method of claim 3, wherein the elastic material is selected from the group consisting of suede, fabric, rubber and combinations thereof.

6. The method of claim 4, wherein the second portion is formed of an abrasion resistant material.

7. The method of claim 1, wherein the shoe protector further comprises a pocket on the first portion suitable for holding a credit card.

8. The method of claim 4, wherein the elastic material is selected from the group consisting of suede, fabric, rubber and combinations thereof.

9. The method of claim 1, wherein the first portion or the second portion is formed of leather.

* * * * *